United States Patent [19]

Meyers

[11] 4,295,755

[45] Oct. 20, 1981

[54] REEL MOUNTABLE BOOM ARRANGEMENT

[76] Inventor: Frank Meyers, 317 Calle Mayor, Redondo Beach, Calif. 90277

[21] Appl. No.: 145,217

[22] Filed: Apr. 30, 1980

[51] Int. Cl.[3] ..... E02B 15/04

[52] U.S. Cl. ..... 405/66; 405/63; 405/69

[58] Field of Search ..... 405/63–72; 210/923, 924

[56] References Cited

U.S. PATENT DOCUMENTS

| | | | |
|---|---|---|---|
| 3,686,869 | 8/1972 | Manuel | 405/69 |
| 3,798,911 | 3/1974 | Oberg | 405/69 |
| 3,807,617 | 4/1974 | Tanksley | 405/66 X |
| 3,811,285 | 5/1974 | Ballu | 405/69 |
| 4,068,478 | 1/1978 | Meyers et al. | 405/66 |
| 4,188,155 | 2/1980 | Langermann | 405/63 |

*Primary Examiner*—Dennis L. Taylor
*Attorney, Agent, or Firm*—Don B. Finkelstein

[57] ABSTRACT

An improved containment barrier or boom having a flotation means and a skirt section dependent therefrom. The boom may be wound around a reel for storage, and deployed from the reel as required. The flotation means comprises a flexible, longitudinally elongated tubular member, having a cavity extending throughout the elongated length thereof. A resilient, generally spring-like member having helical coil means is provided in the tubular member. The spring-like member extends substantially longitudinally throughout the length of the tubular member, and the helical coil means maintain the walls of the tubular member in a transversely expanded condition when the tubular member is deployed in the body of water. The spring-like member is resiliently deformable from the helical condition to a transversely flattened condition, when the tubular member is wound upon the reel for storage. The spring-like member, when in the transversely flattened storage condition thereof, has sufficient energy stored therein so that, upon deployment or unwinding from the reel, the spring-like member will move from its transversely flattened storage condition to its helical condition, thereby expanding the tubular member to its deployed condition.

66 Claims, 13 Drawing Figures

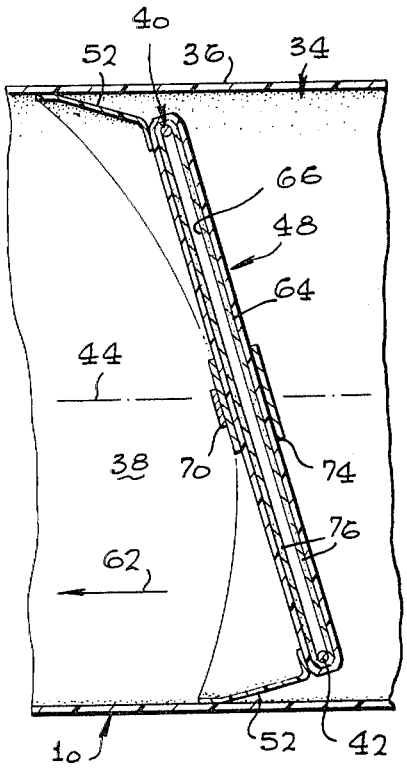
FIG. 2
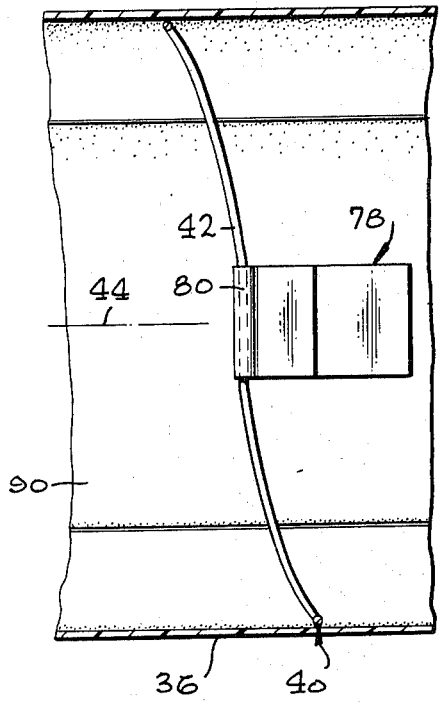
FIG. 3
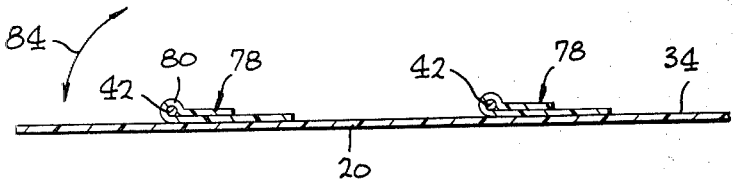
FIG. 4
FIG. 5A
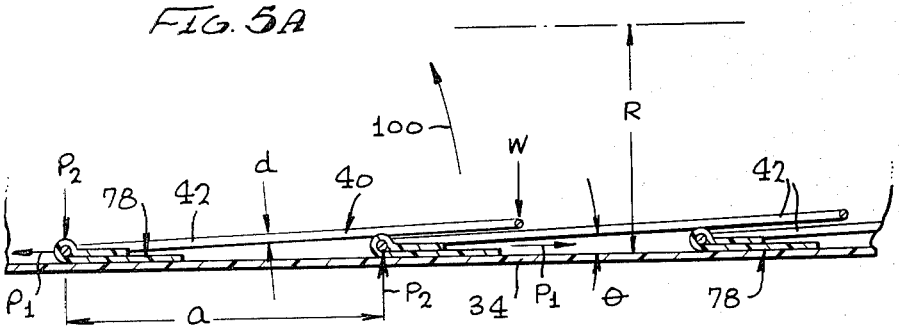

FLATTENED
EXPANDED
10
12
14
16
20
22
28
30
32
34
40
41
42
44
48
52
60
70
70'
74
76
78
102
104
106
120
122
124
126

REEL MOUNTABLE BOOM ARRANGEMENT

BACKGROUND OF THE INVENTION

1. Field of the Invention

This invention relates to the flotation barrier or boom art, and, more particularly, to an improved containment barrier or boom.

2. Description of the Prior Art

The increased frequency of contamination of bodies of water such as rivers, harbors, ponds, lakes, oceans, and the like, by, for example, oil spills, has increased the need for effective containment barriers or booms wherein the area of the liquid body having the contamination may be separated from adjacent areas of the liquid body and the contamination contained within the sectioned off area. The contamination may be removed without further contamination of additional areas. Various types of booms have heretofore been utilized for providing the barrier separating the contamination area from uncontaminated areas. One type of boom that has been widely utilized is a flotation boom, generally fabricated in sections. Each section of the boom may be coupled to adjacent sections to form an entire boom of any desired length deployed in any desired geometrical configuration to contain the contamination area. Such flotation booms have generally incorporated a flotation means floating on the surface of the liquid and a dependent sinking means or skirt extending from the bottom of the flotation means into the liquid. The skirt has a predetermined depth and generally incorporates a ballast, and preferably, a tension member.

The flotation means heretofore utilized has comprised, for example, logs, sealed rigid containers such as oil drums or the like, inflatable tubular members, tubular members filled with a buoyant material, i.e., a material having a specific gravity less than 1.0, or similar devices. However, such prior art flotation means in a containment boom have generally not proven to be completely satisfactory. Since the containment boom is often stored for comparatively long periods of time and only deployed on the liquid when it is necessary to contain a contaminated area, the storage volume is preferably as small as possible. Further, since the contamination may occur quite suddenly, the boom should be able to be rapidly deployed with comparatively low drag and low turbulence inducement in the liquid. Further, it should be deployable without utilizing sophisticated machinery and/or highly skilled labor. Additionally, it is also desired that the boom be capable of articulation in both the horizontal and vertical directions, while maintaining its cross-sectional configuration, in response to the forces imposed to minimize stresses imposed on the boom as well as maintaining desired draft and freeboard and minimizing splash-over. Further, each boom section is preferably fabricated in as longitudinally long sections as possible to reduce the tubulence of mixing effect on deployment or when used, and to reduce costs associated with boom section connections.

One form of inflatable boom heretofore utilized has incorporated a plurality of boom elements, each approximately 25 yards long and has a flotation portion and a dependent skirt portion. The flotation section is a flexible fabric and has a generally rectangular configuration in the deployed condition and is transversely collapsible in the stored condition to a flat configuration in which it may, for example, be coiled. Each element is comprised of a plurality of sections on the order of 1 to 2 yards long. Each section has one or more individual spring loaded, pivotally connected rectangular frames and a check valve for admitting air into the section. In the collapsed, or storage condition, the springs allow the collapse of the rectangular frames to permit the boom to assume the transversely flat storage configuration. Means are provided, in the storage configuration, to resist the spring forces and prevent opening of the boom. On deployment, the restraints are removed and the springs force the rectangular frames into the rectangular configuration, opening the tubular member to conform to the rectangular cross-section. Air is drawn into each compartment during the opening of the tubular member through the check valve and the trapped air in the boom, which exceeds atmospheric pressure, provides buoyancy. The trapped air in the boom resists the natural liquid forces acting thereon which tend to transversely collapse the boom, and, thus, the combination of the trapped air and the spring loaded frames may be required to maintain buoyancy. On retrieval of the boom section, air must be vented by manual operation of some form of valve and each rectangular frame must be collapsed and means provided to retain the collapsed configuration. Such operating mechanical structures in the interior of the boom, the automatic opening as well as the labor associated with retrieval, have made such boom elements unsatisfactory in many applications. Such a boom is described, for example, in U.S. Pat. No. 3,798,911.

Yet another type of boom is described in U.S. Pat. No. 3,576,108, but such structure as shown therein does not readily lend itself to a comparatively small volume when such boom is in a storage condition.

Another type of boom is described in U.S. Pat. No. 3,686,869, in which a plurality of float chambers are connected to a dependent member extending below the surface of the body of liquid and in each float chamber there is provided a spring. While the boom of U.S. Pat. No. 3,686,869 may, under some circumstances be wound on a reel for storage, and then deployment therefrom, the springs in the storage condition are axially compressed against the spring constant. Further, the flotation chambers of the structure shown in U.S. Pat. No. 3,686,869 extend substantially perpendicular to the elongated longitudinal direction of the dependent skirt portion, thus adding considerable bulk, mass, and cost to such a configuration.

U.S. Pat. No. 3,811,285 shows another form of boom arrangement, in which a plurality of flotation pockets, open at the bottom, are vertically arranged in spaced relationship throughout the longitudinally elongated boom section. Within the flotation pockets, there may be provided helical springs which have a plurality of straps coupling the coils of the spring to the vertically oriented pocket on the interior thereof. Thus the axis of the helical springs are vertically oriented. While this configuration may be wound upon a reel for a storage condition, it has been found that collapsing the helical springs during the winding, because of their vertical orientation as opposed to the elongated longitudinal dimension of the boom section, presents considerable problems, since forces are not acting directly upon the spring to cause the collapse thereof into a flattened condition. That is, in winding the structure shown in U.S. Pat. No. 3,811,285 upon a reel, the forces act in a direction perpendicular to the axis of the helical coils and some additional force must be provided on the helical coils, acting in the axial direction to cause the coils to collapse to a flattened condition.

U.S. Pat. No. 4,068,478 discloses structure in which a helical member extends throughout the longitudinal direction of a tubular member, forming the flotation chamber of a containment boom section, and which is adapted to be longitudinally compressed during the storage thereof.

U.S. Pat. No. 3,803,848 discloses yet another configuration of a containment barrier or boom.

It has been found that a boom, which may be windable upon a reel during the storage thereof, and have reduced volume when so wound on the reel, but automatically expand to its desired volume upon deployment or unwinding from the reel, offers many advantages in certain applications. To achieve such automatic expansion to a full flotation condition upon deployment, it is preferred that the mechanism providing such expansion be substantially free of comparatively complex mechanical elements, and, further, that the structure should both collapse, for example, transversely, during the winding upon the reel, without utilization of any other forces to cause the collapse of the structure. Additionally, of course, the boom section should expand into its full flotation volume upon deployment from the reel, and, once again, such expansion should also be achieved without the requirement of applying any other forces except the unwinding from the reel to achieve such an expanded condition.

It has been found that when a helical spring is utilized in the flotation means, which may be a longitudinally extended tubular member, certain parameters must be followed in selecting the spring and the attachment of the spring in the flotation means in order that the helical spring will properly collapse or fold when it is wound on the reel and automatically expand to a helical configuration, thereby expanding the flotation means when it is deployed from the reel.

SUMMARY OF THE INVENTION

Accordingly, it is an object of the present invention to provide an improved containment boom section.

It is another object of the present invention to provide an improved containment boom section which may be wound upon a reel in a storage condition thereof.

It is yet another object of the present invention to provide an improved containment boom section which may be wound upon a reel in a reduced volume thereof, and automatically expanded to a full volume upon deployment from the reel.

It is yet another object of the present invention to provide an improved containment boom section which is fully compatible with the desired operational requirements for containment booms, is of rugged construction, and can provide a comparatively long operational service life.

The above and other objects of the present invention are achieved, according to a preferred embodiment, by providing a flotation means with a predetermined buoyancy. Predetermined buoyancy is selected to provide upper portions of the flotation means above the surface level of the liquid body, such as a lake, river, pond, stream, harbor, or ocean, and a lower portion of the flotation means below the surface level. The buoyancy of the flotation means may be selected to provide any degree of buoyancy desired.

A flexible skirt section is dependent from the lower portion of the flotation means and extends a predetermined distance below the surface level of the liquid body. The flexible skirt section means may incorporate a ballast member and/or a tension member.

End portions of the containment boom section may be provided with attachment means for attaching the boom section to adjacent boom sections at each end thereof, to other structures, to a deployment means such as a tow assembly, winch or cable, or the like, utilized for deploying the boom.

According to the principles of the present invention, the improvement in the containment boom defined herein relates to improvements in the flotation means. Consequently, the flexible skirt section and/or end connections do not, per se, form a part of the invention herein, provided they are compatible with the operational requirements.

The flotation means, according to the principles of the present invention, is comprised of a generally elongated, flexible, generally tubular member, having walls defining a cavity. Positioned within the cavity of the tubular member, and secured thereto, is a resilient, generally spring-like member having a plurality of helical coil means about a longitudinally extending helix axis. In this embodiment, the helix axis of the spring-like member is substantially colinear with the axis of the tubular member. The spring-like member has a predetermined helix angle of the helical coil means when the spring-like member is in a helical condition thereof, installed in the tubular member. The spring-like member extends longitudinally substantially throughout the length of the tubular member, and the coil means of the spring-like member exerts forces against the walls of the tubular member to maintain the tubular member in its tubular shape, which corresponds to the shape when the containment boom is deployed in a body of liquid, and acts as a containment boom to contain contamination or the like.

The containment boom may be stored by winding the containment boom on a reel. When the containment boom is wound on the reel, the tubular member becomes transversely flattened and the spring-like member also becomes transversely flattened, so that the coil means of the spring-like member are forced into close proximity to each other, allowing the entire flotation means to be flattened during the winding on the reel.

The spring-like means must be selected and installed in the tubular member so that, in the flattened condition, sufficient energy is stored therein so that upon deployment or unwinding from the reel, the spring-like member moves from its transversely flattened condition upon the reel to the expanded helical condition to expand the tubular member. It has been found that certain critical conditions must be met in order to provide sufficient stored energy in the spring-like member. For example, it has been found that the initial or free-body pitch of the helix, which is, the space between adjacent coils of the spring-like member when no forces are applied thereto, has a positive value, that is, that the spring-like member not have essentially or close to a zero pitch. Further, it is also preferred that the free-standing pitch of the spring-like member be more than 0.4 of the spacing between adjacent coils of the spring-like member when the spring-like member is installed in the tubular member.

Further, in order that energy not be dissipated from the spring-like member when it is forced into the flattened condition upon winding upon the reel, circumferential movement of the coils of the spring-like member is minimized or eliminated. It has been found that such circumferential motion tends to decrease the amount of stored energy, and can so decrease the stored energy so that the spring means will not automatically resume its helical configuration upon deployment from the reel.

Positioned within the tubular member, in a predetermined spaced array, are a plurality of pockets, which, preferably, extend transverthe across the tubular member, at the angle of the helix, and, preferentially, extend circumferentially greater than 180°. One coil, for example every fifth coil, of the spring-like member is positioned in each pocket in a comparatively tight-fitting relationship, so that circumferential relative movement between the coil and the pocket is minimized or eliminated.

The pockets are connected to the walls of the tubular member by flexible, flap-like members which are taut when the tubular member is in its deployed or expanded condition, and allows the pocket to move relative to the walls of the tubular member when it is wound on the reel into the flattened storage condition, so that the pockets do not pull the walls of the tubular member inwardly during the winding on the reel.

Additionally, strap means may be utilized to couple coils other than the coils which are in the pockets to the walls of the tubular member. Such strap means are preferably oriented so that there is a high degree of frictional restraint between the coil and the loop of the strap in which the coil is positioned, so that little or no circumferential movement of the coil within the loop occurs upon flattening of the spring-like member during winding on the reel.

When the above criteria are met, it has been found that sufficient energy is stored within the spring-like member when it is in the transversely flattened storage condition so that it will be self-erecting upon deployment from the reel.

Vent means are provided in the tubular member in regions adjacent upper portions thereof, to allow air to enter and leave the cavity of the tubular member as required during operation.

To aid in the flotation characteristics of the flotation means, it has been found advantageous to place flexible float members, such as a layer of polyethylene foam having a specific gravity less than one, for example, on the order of two pounds per cubic foot density, within the pockets and, also, if desired, along bottom portions of the tubular member, and extending longitudinally throughout the length of the tubular member.

In another embodiment of the present invention, the spring-like member and the pockets may be contained within a flexible liner which, preferably, extends more than 180°, but, preferably, less than 360° around the spring-like member. The attachment of the spring-like members in this embodiment is made to the liner means, and the entire liner means, including the spring-like member may be inserted into the tubular member of the flotation means, and coupled thereto. Such a configuration generally provides manufacturing ease for assembling the components of the improved containment boom according to the principles of the present invention, and, additionally, increases the structured integrity of the flotation means. In this embodiment, there may also be provided one or more layers of flexible polyethylene foam or the like, between the liner and the tubular member in bottom portions thereof in order to obtain greater flotation characteristics, abrasion resistance and improved windability of the boom on the reel.

BRIEF DESCRIPTION OF THE DRAWING

The above and other embodiments of the present invention may be more fully understood from the following detailed description, taken together with the accompanying drawing, wherein similar reference characters refer to similar elements throughout and in which:

FIG. 2 is a sectional view of a portion of the embodiment shown in FIG. 1;

FIG. 3 is a sectional view of another portion of the embodiment shown in FIG. 1;

FIG. 4 is a sectional view of another portion of the embodiment shown in FIG. 1;

FIG. 5A is a partial sectional view of the embodiment shown in FIG. 1 in a transversely flattened condition;

DESCRIPTION OF THE PREFERRED EMBODIMENTS

Figure 1:
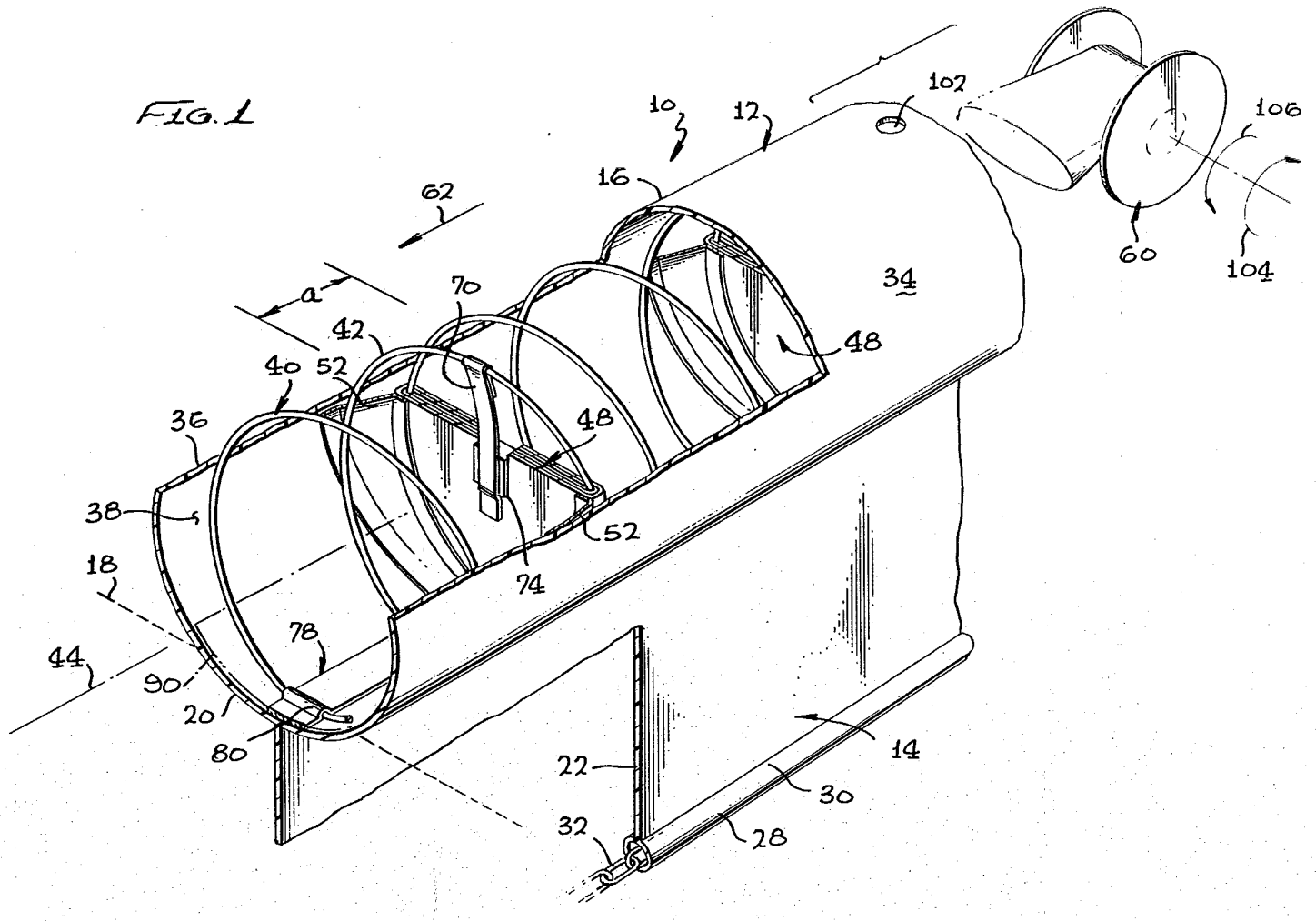
FIG. 1 is a perspective view of a preferred embodiment of the present invention.

Referring now to the drawing, there is illustrated, in FIG. 1, a preferred embodiment, generally designated 10, of a containment barrier or boom section, according to the principles of the present invention. The containment boom section 10 is comprised of a flotation means generally designated 12, and a flexible skirt section means 14. The containment boom section 10, illustrated in FIG. 1, is shown in its transversely expanded, deployed condition, and has a predetermined buoyancy such that there are upper portions generally designated 16, of the flotation means 12, above the surface level indicated by the dashed line 18 of the body of liquid in which the boom section 10 is deployed. Lower portion 20 of the flotation means 12 is below the surface level 18.

The flexible skirt section 14 is dependent from the lower portion 20 of the flotation means 12 and extends a predetermined distance below the surface 18. In general, the flexible skirt section means 14 is comprised of an extended flexible member 22, extending substantially the length of the containment boom 10, and is provided with a pocket like portion 28 at the lower section, generally designated 30, thereof. In the pocket like section 28, there may be provided a ballast means 32, which may take the form of a chain, as illustrated, or a cable, or similar device serving both as a ballast member and as a tension member.

The present invention is concerned with improvements to the flotation means 12, and, consequently, any desired types of flexible skirt section means 14, in addition to the precise form illustrated in FIG. 1, may be incorporated in accordance with the principles of the present invention. Alternatively, of course, if desired, the entire skirt section 14 may be omitted in certain applications.

In FIG. 1, the upper portion 16 of the flotation means 12 has been partially omitted so that the internal configuration thereof may be seen.

The flotation means 12 generally comprises a longitudinally elongated, generally flexible, tubular member 34, having walls 36 defining an internal cavity 38.

A resilient, generally spring-like member 40, having a plurality of helical coil means, generally indicated at 42, around a helical axis 44, is provided in the cavity 38 of the tubular member 34. The helical axis 44, may, for example, be colinear with, or closely parallel to, the axis of the tubular member 34. The helical member 40 has a predetermined helix angle and a predetermined pitch or separation, as indicated by the letter "a" between adjacent coils 42. The spring-like member 40 extends substantially the entire longitudinal length of the tubular member 34 and the coil means 42, for the spring-like member 40 in the helical configuration illustrated in FIG. 1, bear against the walls 36 of the tubular member 34 to maintain the tubular member 34 in the transversely expanded or deployed condition.

Positioned within the cavity 38 are a plurality of pocket means generally designated 48, in a predetermined, spaced, array. Each pocket means 48 is coupled to the walls 36 of the tubular member 34 by flexible flap-like members 52, which, for the spring-like memberfiguration helical configuration illustrated in FIG. 1, are, preferably, substantially taut. The flap-like members 52 are coupled to the side edges of the pockets 48 and to the walls 36 of the tubular member 34, and allow the pocket means 48, upon winding upon the reel 60, as described below in greater detail, to move within the cavity 38 relative to the walls 36 of the tubular member 34 in the direction indicated by the arrow 62. Thus, the flexible flap members 52 insure that, when the boom 10 is wound on the reel 60 the coils 42 of the spring-like member 40 will flatten in a single uniform direction, which, as noted above, is in the direction of the arrow 62. The pockets 48 are preferably mounted in the cavity 38 at the helix angle of the spring-like member 40.

Figures 8, 11, 12:
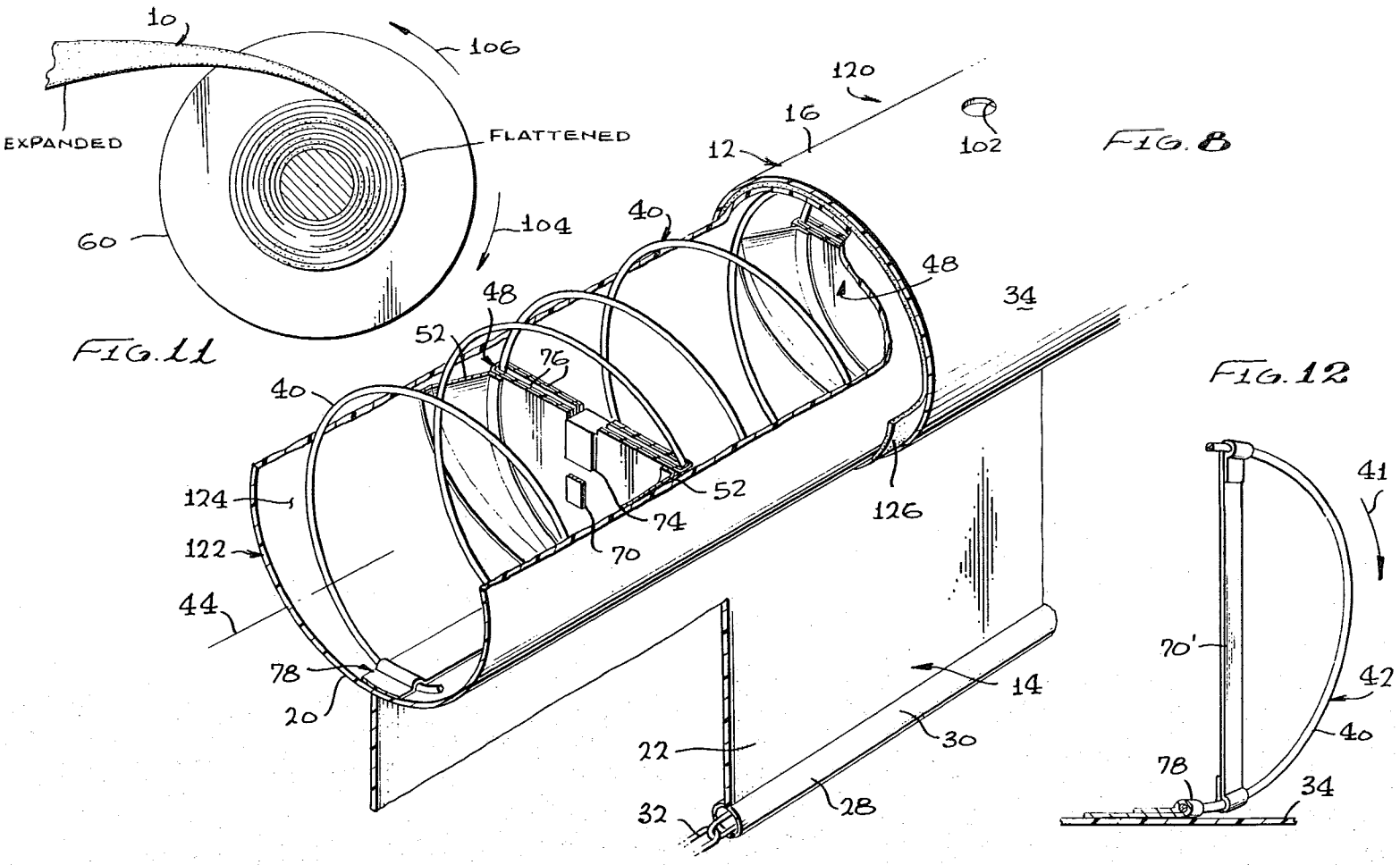
FIG. 8 is a perspective view of another embodiment of the present invention.
FIG. 11 illustrates the boom on a reel.
FIG. 12 illustrates another embodiment of the present invention.

FIG. 2 illustrates the pocket 48 in greater detail. As shown in FIG. 2, the pocket 48 is, preferably, fabricated from a flexible material and, for example, may be fabricated from the same material as the tubular member 34, and has walls 64 defining a cavity 66 therebetween, in which there is positioned one coil 42 of the spring-like member 40. As shown in FIG. 2, the pockets 48 are at the helix angle of the spring-like member 40 with respect to the axis 44. The flexible flap-like members 52 are, preferably, taut in this position, and retain the pockets 48 in the angular orientation with respect to the axis 44 as described above. Further, the flaps 52, as noted above, allow movement of the pockets 48 in the direction of the arrow 62 when the boom 10 is wound upon the reel 60. Pockets 48 are in a spaced relationship within the tubular member 34, and, for example, may be at every fifth coil 42, so that only every fifth coil is contained within the cavity 66 of the pocket 48. Preferably, the pocket 48 frictionally engages the coil 42 sufficiently tightly to limit or even eliminate relative circumferential movement of the coil 42 during the winding upon the reel 60 and the depolyment therefrom. The pockets 48 extends a predetermined, circumferential distance around the tubular member 34 from regions adjacent the bottom portions 20 thereof toward regions adjacent the upper portions 16 thereof. Preferably, the pockets extend greater than 180° of the circumference of the tubular member 34, and, preferably, less than 360°. Means for controlling the deformation of the coil 42 contained within the pocket 48 are also provided in preferred embodiments of the present invention. Such deformation controlling means may, for example, be an upper strap 70, which may be flexible or rigid, coupled to the pocket 48 and extending over the coil 42, in the lead direction of the helix, as indicated by arrow 62 in regions adjacent the upper portion 16 of the tubular member 34. It will be appreciated that, in some applications, it may be desirable to eliminate the pockets 48. In such an embodiment, as illustrated in FIG. 12, a strap 70' is utilized and engages the coil means 42 in regions adjacent the bottom portion 20 of tubular member 34, and extends upwardly and over the top of the next coil means 42 in the lead direction of the flattening thereof indicated by arrow 42. Further, such straps 70' may also be utilized in embodiments wherein pockets 48 are included. Such straps 70' extend to coils not in the pockets 48. Pockets 48 and such straps 70' may be utilized in any desired spaced array. For example, all coils may be in a pocket 48, or every fifth coil, seventh, tenth, or the like. Similarly, straps 70' may be utilized in as many locatins as desired.

If desired, a closure flap 74, or other fastening means, may be provided over the top portion of the pocket 48, to help maintain, in preferred embodiment of the present invention, a first flexible flotation member 76, within the cavity 66 of the pocket means 48. The flexible flotation member 76 may, for example, be a resilient foam plastic such as polyethylene foam, or the like. Such a foam, in addition to providing greater buoyancy under certain conditions to the boom means 10, also provides a cushion for the coil 42 within the pocket 48, and aids to operational characteristics.

The spaced apart pockets 48 and flaps 52 also provide bulkheads to restrict longitudinal passage of any liquids which may become entrained between any two pockets.

In addition to the pocket means 48, in preferred embodiments of the present invention, there is also provided additional structure for retaining the coil 42 within the tubular member 34. Thus, for example, a plurality of strap means 78 may be so utilized and the strap means 78 are illustrated in greater detail in FIGS. 3 and 4. Each of the strap means 78 is coupled to the tubular member 34 in regions adjacent the bottom portions 20 thereof, and defines a coil receiving loop 80 in which coils 42, of the spring-like member 40, other than the coils within the pockets 48, are positioned. Preferably, the coil receiving loop 80 is aligned perpendicularly to the axis 44 and tightly, frictionally, engages the coil 42. As shown in the plan view of FIG. 3, the coil receiving loop 80 tends to distort the coil 42 from its normal helix angle. It has been found that such tight fitting, which tends to prevent or eliminate circumferential movement of the coil 42 helps retain the energy necessary in the spring-like means 40 when it is wound upon the reel 60. Of course the coil means 42 is free to rotate in the directions indicated by the arrow 84 in FIG. 4, within the coil receiving loop 80 of the strap means 78, when the containment boom 10 is wound upon and deployed from the reel 60.

Figure 9:
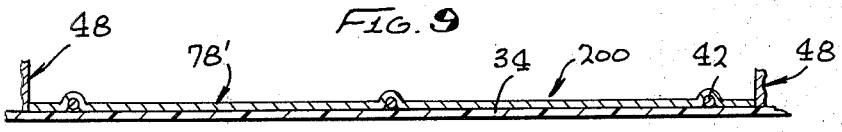
FIG. 9 illustrates another embodiment of the present invention.

FIG. 9 illustrates another embodiment, generally designated 200, of the present invention, in which the strap means 78′ if substantially longitudinally continuous between pockets 48 and defines a plurality of spaced apart coil receiving loops to accept the coils 42. The strap 78′ is bonded or otherwise connected to the tubular member 34.

Figure 10:
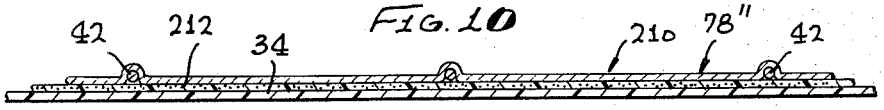
FIG. 10 illustrates another embodiment of the present invention.

FIG. 10 illustrates another embodiment, generally designated 210, of the present invention, in which an intermediate strap 212 is utilized. The intermediate strap 212 is bonded or otherwise coupled to the tubular member 34, and extends longitudinally therein, either continuously, or, where pockets 48 are utilized, between such pockets. The strap 78″, which is similar to strap 78′, is bonded or otherwise coupled to the intermediate strap 212. Coupling of strap 78″ to intermediate strap 212 provides a convenient sub-assembly for installation. It will be appreciated that straps 78 (FIG. 4) can also be utilized in place of strap 78″ in the embodiment 210.

If desired, a layer of flexible flotation means 90 may be included in regions adjacent the bottom portion 20 in the cavity 38 of the flexible tubular member 34, to provide additional buoyancy, abrasion resistance, and improved windability to the containment boom 10. The second flexible flotation member 90 may be fabricated from the same type of foamed plastic, such as foamed polyethylene, or the like, as the first flexible flotation member 76 contained within the pockets 48.

It has been found that the spring-like member 40, in addition to the restraints imposed by the straps 78 and pockets 48 as described above, must also have certain other characteristics in order to insure successful operation when the containment boom 10 is wound upon a reel 60, so that, upon deployment, it will be self erecting.

As noted above, in order to insure successful operation of the invention herein, it has been found necessary, not only to control installation of the spring-like member 40 in the tubular member 34, so that, for example, upon transverse flattening when the tubular member 40 is wound upon the reel 60 the coils 42 of the spring-like member 40 will flatten in a preferred direction, but also, upon erection to the helical condition thereof, be confined to a particular orientation. Thus, the pockets 48, as coupled by the flaps 52 to the walls 36 of the tubular member 34, insure that the above characteristics are achieved. Additionally, the comparatively tight frictional fitting of the straps 78 and the pockets 48 with the coils 42 of the spring-like member 40, insure that there is minimal or no circumferential motion of the coils 42 during movement between the transversely flattened condition and the helical condition thereof.

The straps 78 may be appropriately secured, for example, by bonding, heat sealing, sewing, or the like, or any combination thereof, to the walls 36 be the tubular member 34. Further, the flaps 52 may be appropriately sealed to the walls 36 of the tubular member 34, and to the pockets 48, by similar bonding, heat sealing, sewing, or the like.

Additionally, the first flexible flotation member 76 in the pocket 48 and the second flexible floation member 90 have specific gravities of less than one, and, for example, may have a density on the order of 2 pounds per cubic foot.

Figure 5B:
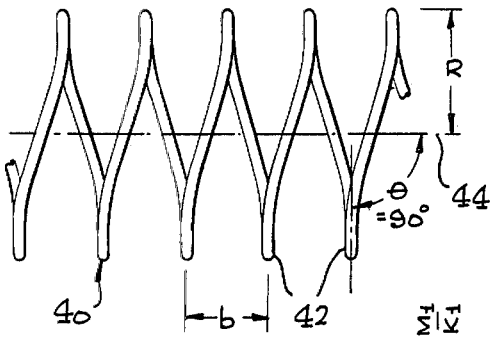
FIG. 5B illustrates a spring-like member useful in the practice of the present invention.
Figure 6:
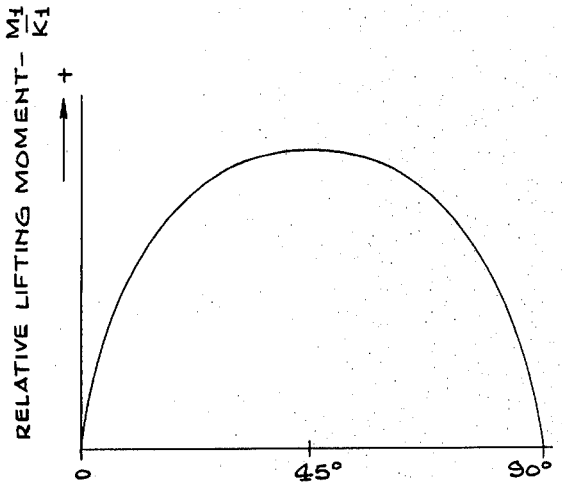
FIG. 6 is a graphical representation of certain characteristics of the present invention.

Selection of the characteristics of the spring-like member 42 has also been found necessary to insure successful operation of the invention herein. FIG. 5A illustrates a sectional view of the boom 10 when the boom has been wound upon the reel 60, and the spring-like member 40 is in a transversely flat condition. It has been found that the forces in the coil 42 of the spring-like member 40, resulting from the energy stored therein, may be considered to be the result of two substantially orthogonal components. As shown in FIG. 5A, there is the force $P_1$, which may be considered the in plane force imposed on each coil, and is the force required to separate the ends of each coil from its initial helical condition into the flattened condition wherein the coil 42 has a substantially initial constant radius, R, about the helical axis 44 in the helical condition. Thus, in flattening, one end of each coil 42 will be forced into a dimension greater than radius R, and the other end will be forced into a dimension smaller than the radius R. When the spacing of the straps 78 is at a distance a, it has been found that the moment caused by the in plane force $P_1$, is dependent upon the angle $\theta$, and is defined by the following equation:

$$M_1 = K_1(\sin\theta \cos\theta) \qquad \text{Eq. 1}$$

Where $M_1$ is the moment caused by the in plane force $P_1$, $\theta$ is the angle that the coil 42 makes with the helical axis 44, and $K_1$ is a constant dependent upon the modulus of elasticity of the material from which the spring-like member 40 is fabricated, the diameter of the material, as indicated by the letter d on FIG. 5A from which the spring-like member 40 is fabricated, the separation between coils as installed in the tubular member 34, as indicated by the letter a, and the radius R of the spring-like member 40. The graph of FIG. 6 illustrates the relative lifting moment caused by the in plane force $P_1$ as a function of the angle $\theta$. As can be seen from FIG. 6, the relative lifting moment caused by the in plane force $P_1$ is zero at both 0°, that is, if the coils were perfectly flat, and at 90° when the coils have assumed their helical condition. It is a maximum when the coils are at 45°.

Figure 7:
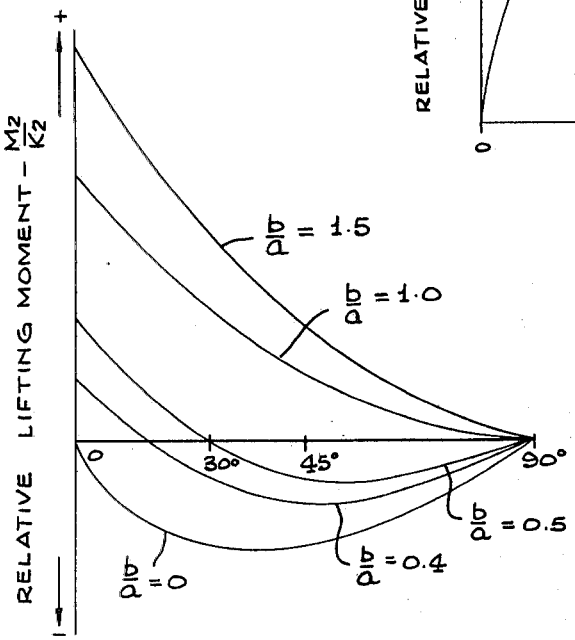
FIG. 7 is a graphical representation of other characteristics of the present invention.

The out of plane force $P_2$ also causes a moment tending to erect the coils 42. The moment caused by the out of plane force $P_2$ is defined by the equation:

$$M_2 = K_2(-\sin\theta \mathrm{Co}\theta + b/a \cos\theta) \qquad \text{Eq. 2}$$

where $K_2$ is dependent upon the same parameters as $K_1$ and b is the initial or free standing pitch or spacing between the coils 42 of the spring-like member 40. FIG. 5B illustrates the spring-like member of 40 in its free standing condition, that is, before it is installed in the tubular member 34. The coil spacing is uniform and is shown at b. In this condition, of course, the angle $\theta$ is 90°, that is, the spring-like member 40 is in its helical configuration, which corresponds, after the spring-like member 40 is installed in the tubular member 34, to the transversely expanded deployed condition of the tubular member 34. FIG. 7 is a graphical representation of the relative lifting moment caused by the out of plane force $P_2$ for various ratios of the initial free standing coil spacing to the coil spacing as installed in the tubular member 34. As can be seen from FIG. 7, for a ratio of b to a of zero, which, for example, could occur when the initial coil spacing is substantially zero, or the installed coil spacing is very large, the out of plane relative lifting moment is zero or negative. That is, the lifting moment does not tend to lift the coils from the position shown in FIG. 5A to the helical condition at any angular orientation $\theta$. Thus, for such a condition, the coil will not be self erecting, since the in plane force when $\theta$ is zero, is also zero, as shown in FIG. 6. When the ratio of b to a is 0.5, there is an initial lifting moment caused by the out of plane force $P_2$, but this lifting moment decreases to zero at approximately $\theta = 30°$, and then is negative or non-lifting for $\theta$ between 30° and 90°. When the ratio of b to a is 1, that is, the spacing of the straps 78, and the free standing coil 42 spacing are the same, the relative lifting moment caused by the out of plane force $P_2$ is always positive between 0° and 90°. When the initial coil spacing or pitch b, as shown on FIG. 5B, is greater than the spacing "a" as installed in the tubular member 34, the relative lifting moment caused by the out of plane forces $P_2$ becomes greater at all angles of $\theta$. Thus, from the above, it can be seen that it is preferable to select a spring-like member 40 in which the pitch or free standing spacing between coils 42 thereof is as large as practical, and the installed spacing a, as installed in the tubular member 34 between the coils 42, is as small as practical. Considerations such as the total weight per unit length of the boom desired, and the like, present design parameters for any given installation in applying the above mentioned criteria. It has been found, for example, that a minimum ratio of b/a of 0.4 is satisfactory for certain applications. However, larger ratios are required in other applications.

In addition to the above defined parameters for providing the stored energy in the flattened condition of the spring-like member 40 to be self erecting to the helical condition thereof, sufficient additional energy must also be provided to lift the weight of the structure such as the tubular member 34, together with the pockets 48, first flotation member 76, and related structural elements from the transversely flattened storage condition, to the transversely expanded or deployed condition. The following equation defines the weight, shown aw "W" on FIG. 5A, which must be lifted by each coil as a function of the above defined parameters:

$$W = K_3(\sin\theta + \tfrac{1}{4}b/a) \qquad \text{Eq. 3}$$

where $K_3$ is a constant dependent upon the same parameters as $K_1$ and $K_2$. Thus, at any given angle $\theta$, the total moment caused by the in plane force $P_1$ and the out of the plane forces $P_2$ must be at least equal to, and preferably greater than, the weight W as defined by Equation 3. Further, friction also tends to reduce the force available for erecting the boom 10 from the transversely flattened storage condition to the transversely expanded deployed condition when the boom 10 is unwound from the reel 60. To minimize friction, it has been found advantageous to lubricate, for example, the internal surfaces of the tubular member 34 and the flaps 52. Such lubrication, of course, must be compatible with the operational condition of the boom 10 and the material selected therefor.

Additionally, it has also been found that limitations should be imposed upon the maximum allowable deformation of the coils 42, when they are forced into the flattened condition, as shown in FIG. 5A. Such limitations on the amplitude range of constraint is necessary so that the elastic limit of the coils 42 is not exceeded and, further, so that the stored energy therein tends to be maximized. The straps 70 and 78, as well as the pockets 48, tend to provide such constraint. It has also been found that, for a given installation, it is preferred to use the largest diameter d of the wire forming the coils 42 of the spring-like member 40, and the smallest radius R of the helix formed by the spring-like member 40, since the constants $K_1$, $K_2$, and $K_3$ proportional to a power of the diameter d and inversely proportional to a power of the radius R.

In order to allow air to enter and leave the cavity 38, vent means 102, as shown on FIG. 1, are provided in spaced relationship in the upper portion 16 of the tubular member 34. The vent means are apertures through the walls 36 of the tubular member 34, and thus allow the entrance and exit of air from the cavity 38.

With the above criteria properly selected for a given application, the coil means 42 of the spring-like means 40 will always collapse in a preferential direction when moving into the transversely flattened condition thereof, and will have sufficient energy stored therein to be self erecting to cause the tubular member 34 to assume its desired transversely expanded deployed condition. This is achieved during the winding and unwinding from the reel 60, without the use of any external forces or orientation. Thus, as shown on FIG. 1, when the boom 10 is wound onto the reel 60, in the direction indicated by the arrow 104, the coils will automatically lay flat into the flattened condition thereof during the winding and upon deployment from the reel 60 in the direction of the arrow 106, the boom 10 will be self erecting to its desired transversely expanded deployed condition, as shown in FIG. 11.

In some applications of the present invention, it has been found desirable, for example, for ease of manufacturing, to modify the structure illustrated and described above in connection with the boom arrangement 10, to provide a flexible liner within the tubular member. FIG. 8 illustrates an embodiment, generally designated 120, of a boom according to the principles of the present invention, in which a liner means 122, defining a liner cavity 124, is provided in the cavity 38 defined by the tubular member 34. As can be seen from FIG. 8, the liner means 122 extends a predetermined circumferential distance around the walls of the tubular member 34, and, preferably, the circumferential extent is at least 180°, but less than 360°, thereby leaving an open space adjacent top portions 16 of the tubular member 34. It will be appreciated, however, that, as may be desired for certain applications, the circumferential extent of the liner means 122 may be less than 180°, or a full 360°.

In the embodiment of the containment boom 120, the pockets 48, spring-like member 40, straps 78, flaps 52, and the other structure described above, are contained within the liner cavity 124. The liner means 122, together with the above described structure, may then be assembled as a subassembly and inserted into the cavity 38 defined by the tubular member 34. The liner means 122 may be fixedly coupled to the tubular member 34 by bonding, heat sealing, or the like, or detachably coupled as desired. The characteristics of the attachment of the spring-like member 40, and the other characteristics thereof, as described above, are utilized in the selection of the corresponding elements and restraints in the embodiment 120.

The straps 78, liner means 122, upper straps 70, closure straps 74, flaps 52, tubular member 34, skirt 22, and pocket 48 may be fabricated from the same flexible material as desired. Alternatively, various portions, such as the liner means 122, may, for example, have a greater degree of flexibility, or, if desired, less flexibility than the tubular member 34. The pockets 48 may extend the same circumferential distance as the liner means 122, as illustrated in FIG. 8, or, alternatively, they may extend circumferentially a greater amount or a less amount as may be desired for particular applications.

The containment boom 120 may be wound upon a reel, such as the reel 60 shown in FIG. 1, for storage, and, in accordance with the above described principles automatically be flattened during such winding without utilization of external forces. Additionally, upon deployment of the containment boom 120 from the reel 60, it will automatically erect to the transversely expanded deployed condition thereof without utilization of external forces.

If desired, one or more flexible flotation members 126 may be inserted between the liner means 122 and the tubular member 34 in regions adjacent the bottom portions 20 thereof to provide additional flotation. Such flotation members 126 may be similar to the first and second flotation members 76 and 90 described above, and, for example, may be polyethylene foam having a specific gravity less than 1, and, for example, a density on the order of two pounds per cubic foot. As noted above, the flotation member 126 may comprise one or more layers, and may be disposed as required throughout the longitudinal length of the tubular member 34 in any desired configuration.

This concludes the description of the preferred embodiment of the present invention. Those skilled in the art may find many variations and adaptations thereof, and the appended claims are intended to cover all such variations and adaptations falling within the true scope and spirit thereof.

What is claimed is:

1. In an improved containment boom section, the improvement comprising, in combination:

flotation means having a predetermined buoyancy to provide upper portions thereof above the surface level of a liquid body for the condition of the boom section deployed in said liquid body, and a lower portion, below the surface level of said liquid body;

said flotation means comprising:

a longitudinally elongated, flexible, generally tubular member having walls defining an internal cavity, upper portions and lower portions and said tubular member transversely collapsible-expandable, between a transversely flattened, storage condition and a transversely expanded, deployed condition, and said elongated, flexible, generally tubular member windable on a reel in said transversely flattened storage condition;

a resilient, generally spring-like member having a plurality of helical coil means about a longitudinally extending helix axis and said helical coils having a predetermined helix angle in a helical condition thereof, and said spring-like member extending longitudinally in said cavity of said tubular member, and said helical coils maintaining said walls of said tubular member in said transversely expanded, deployed condition thereof for said spring-like member in said helical condition thereof, and said spring-like member resiliently deformable from said helical condition to a transversely flattened condition for said tubular member in said transversely flattened storage condition thereof, and said spring-like member having a predetermined energy stored therein in said transversely flattened condition, and said predetermined energy having a value at least equal to the energy required to cause said spring-like member to move from said transversely flattened condition to said helical condition thereof for said flotation means deployed in said liquid body;

a plurality of pocket means in said cavity of said tubular member, and coupled to the walls thereof in a predetermined, spaced array, each of said pocket means having walls defining a coil receiving cavity having side edges extending a predetermined distance around said walls of said tubular member, from regions adjacent said lower portions thereof toward regions adjacent said upper portions thereof, and said side edges of said pocket means positionable adjacent said walls of said tubular member for said tubular member in said transversely expanded, deployed condition thereof, and one of a first group of said plurality of coil means of said spring-like member in said coil receiving cavity of each of said pocket means, and each of said pocket means movable from a transversely upright position for said tubular member in said transversely expanded, deployed condition thereof to a flattened position for said tubular member in said transversely flattened condition thereof.

2. The arrangement defined in claim 1, and further comprising:

a plurality of strap means in said tubular member and coupled to the walls thereof in a spaced array, and each of said strap means defining a coil receiving loop, and one of a second group of said plurality of coil means different from said first group of said plurality of coil means of said spring-like member in each of said coil member receiving loops of said strap means.

3. The arrangement defined in claim 1, and further comprising:

first flexible flotation member having a specific gravity less than one, in at least some of said cavities of said plurality of pocket means.

4. The arrangement defined in claim 2, and further comprising:

attachment means for coupling said pocket means to said walls of said tubular member and said attachment means comprising:

flexible flap means coupled to said pocket means and to said walls of said tubular member in spaced relationship to said side edges of said pocket means for said pocket means in said transversely upright position thereof, and said flap means substantially taut for said pocket means in said transversely upright position to limit movement of said pocket means.

5. The arrangement defined in claim 4, and further comprising:

upper strap means coupled to said pocket means and extending around said coil means in regions adjacent said upper portions of said tubular member.

6. The arrangement defined in claim 1, wherein:

said pocket means are aligned at substantially said predetermined helix angle for said pocket means in said transversely upright position thereof.

7. The arrangement defined in claim 1, wherein:

said pocket means frictionally engage said coil means for limiting relative circumferential motion thereof.

8. The arrangement defined in claim 2, wherein:

said coil receiving loops frictionally engage said coil means for limiting relative circumferential motion therebetween.

9. The arrangement defined in claim 8, wherein:

said coil receiving loops are aligned in planes substantially perpendicular to the axis of said helix of said spring-like member.

10. The arrangement defined in claim 1, and further comprising:

second flexible flotation member having specific gravity less than one, extending longitudinally in said cavity of said tubular member in regions at said lower portion thereof.

11. The arrangement defined in claim 1, wherein:

said predetermined circumferential distance of said side edges of said pocket means is greater than 180°.

12. The arrangement defined in claim 1, and further comprising:

means for controlling the deformation of said coil means in said transversely flattened condition thereof.

13. In an improved containment boom section, the improvement comprising, in combination:

flotation means having a predetermined buoyancy to provide upper portions thereof above the surface level of a liquid body for the condition of the boom section deployed in said liquid body, and a lower portion, below the surface level of said liquid body;

said flotation means comprising:

a longitudinally elongated, flexible, generally tubular member having walls defining and internal cavity, upper portions and lower portions and said tubular member transversely collapsible-expandable, between a transversely flattened storage condition and a transversely expanded, deployed condition, and said elongated, flexible, generally tubular member windable on a reel in said transversely flattened storage condition;

a flexible liner means in said cavity of said tubular member, and movable therewith, between said transversely flattened, storage condition, and said transversely expanded, deployed condition thereof, and adjacent said walls of said tubular member, and said liner means having walls defining a liner cavity, and said liner means having lower portions at said lower portions of said tubular member and upper portions spaced from said lower portions, and said walls of said liner extending a first predetermined circumferential distance from regions at said lower portion of said tubular member toward regions at said upper portion thereof;

means for coupling said walls of said liner means to said walls of said tubular member;

a resilient, generally spring-like member having a plurality of helical coil means about a longitudinally extending helix axis and said helical coils having a predetermined helix angle in a helical condition thereof, and said spring-like member extending longitudinally in said cavity of said liner means, and said helical coils maintaining said walls of said liner means and said tubular member in said transversely expanded, deployed condition thereof for said spring-like member in said helical condition thereof, and said spring-like member resiliently deformable from said helical condition to a transversely flattened condition for said tubular member in said transversely flattened storage condition thereof, and said spring-like member having a predetermined energy stored therein in said transversely flattened condition, and said predetermined energy having a value at least equal to the energy required to cause said spring-like member to move from said transversely flattened condition to said helical condition thereof for said flotation means deployed in said liquid body;

a plurality of pocket means in said cavity of said liner means, and coupled to the walls thereof in a predetermined, spaced array, each of said pocket means having walls defining a coil receiving cavity having side edges extending a second predetermined circumferential distance around said walls of said liner means, from regions adjacent said lower portions thereof toward regions adjacent said upper portions thereof, and said side edges of said pocket positionable adjacent said walls of said liner means for said tubular member in said transversely expanded, deployed condition thereof, and one of a first group of said plurality of coil means of said spring-like member in said coil receiving cavity of each of said pocket means, and each of said pocket means movable from a transversely upright position for said tubular member in said transversely expanded, deployed condition thereof to a flattened position for said tubular member in said transversely flattened condition thereof.

14. The arrangement defined in claim 13, wherein:

said first predetermined circumferential distance is less than 360°.

15. The arrangement defined in claim 14, wherein:

said first predetermined circumferential distance is greater than 180°.

16. The arrangement defined in claim 15, and further comprising:

a plurality of strap means in said liner means and coupled to the walls thereof in a spaced array, and each of said strap means defining a coil receiving loop, and one of a second group of said plurality of coil means different from said first group of said plurality of coil means of said spring-like member in each of said coil receiving loops of said strap means.

17. The arrangement defined in claim 15, and further comprising:

attachment means for coupling said pocket means to said walls of said liner means and said attachment means comprising:

flexible flap means coupled to said pocket means and to said walls of said liner means in spaced relationship to said side edges of said pocket means for said pocket means in said transversely upright position thereof, and said flap means substantially taut for said pocket means in said transversely upright position to limit movement of said pocket means.

18. The arrangement defined in claim 17 and further comprising:

upper strap means coupled to said pocket means and extending around said coil members in regions adjacent said upper portions of said tubular member.

19. The arrangement defined in claim 15, wherein:

said pocket means are aligned at substantially said predetermined helix angle for said pocket means in said transversely upright position thereof.

20. The arrangement defined in claim 15, wherein:

said pocket means frictionally engage said coil means for limiting relative circumferential motion thereof.

21. The arrangement defined in claim 16, and further comprising:

said coil receiving loops frictionally engage said coil means for limiting relative circumferential motion therebetween.

22. The arrangement defined in claim 21, wherein:

said coil receiving loops are aligned in planes substantially perpendicular to the axis of said helix of said spring-like member.

23. The arrangement defined in claim 15, and further comprising:

a second flexible flotation member having a specific gravity less than 1, intermediate said liner means and said tubular member in regions adjacent said lower portions thereof.

24. The arrangement defined in claim 15, wherein:

said second predetermined distance is substantially equal to said first predetermined distance.

25. The arrangement defined in claim 15, and further comprising:

means for controlling the deformation of said coil means in said transversely flattened condition thereof.

26. In an improved containment boom section, the improvement comprising, in combination:

flotation means having a predetermined buoyancy to provide upper portions thereof above the surface level of a liquid body for the condition of the boom section deployed in said liquid body, and a lower portion, below the surface level of said liquid body;

said flotation means comprising:

a longitudinally elongated, flexible, generally tubular member having walls defining an internal cavity, upper portions and lower portions and said tubular member transversely collapsible-expandable, between a transversely flattened, storage condition and a transversely expanded, deployed condition, and said elongated, flexible, generally tubular member windable on a reel in said transversely flattened storage condition;

a resilient, generally spring-like member having a plurality of helical coil means about a longitudinally extending helix axis and said helical coils having a predetermined helix angle in a helical condition thereof, and said spring-like member extending longitudinally in said cavity of said tubular member, and said helical coils maintaining said walls of said tubular member in said transversely expanded, deployed condition thereof for said spring-like member in said helical condition thereof, and said spring-like member resiliently deformable from said helical condition to a transversely flattened condition for said tubular member in said transversely flattened storage condition thereof, and said spring-like member having a predetermined energy stored therein in said transversely flattened condition, and said predetermined energy having a value at least equal to the energy required to cause said spring-like member to move from said transversely flattened condition to said helical condition thereof for said flotation means deployed in said liquid body;

and said spring-like member having a first predetermined spacing greater than zero between adjacent coil means thereof for the condition of no axial forces applied thereto;

coupling means for coupling said spring-like member to said walls of said tubular member to space adjacent coil means thereof at a second predetermined spacing.

27. The arrangement defined in claim 26, wherein:

said first predetermined spacing is in the range of 0.4 to 1.5 of said second predetermined spacing.

28. The arrangement defined in claim 26, wherein:

said first predetermined spacing is at least equal to said second predetermined spacing.

29. The arrangement defined in claim 26, wherein:

said first predetermined spacing is less than said second predetermined spacing.

30. The arrangement defined in claim 26, and further comprising:

a plurality of pocket means in said cavity of said tubular member, and coupled to the walls thereof in a predetermined, spaced array, each of said pocket means having walls defining a coil receiving cavity having side edges extending a predetermined distance around said walls of said tubular member, from regions adjacent said lower portions thereof toward regions adjacent said upper portions thereof, and said side edges of said pocket means positionable adjacent said walls of said tubular member for said tubular member in said transversely expanded, deployed condition thereof, and one of a first group of said plurality of coil means of said spring-like member in said coil receiving cavity of each of said pocket means, and each of said pocket means movable from a transversely upright position for said tubular member in said transversely expanded, deployed condition thereof to a flattened position for said tubular member in said transversely flattened condition thereof.

31. The arrangement defined in claim 30, wherein:

said coupling means further comprise:

a plurality of strap means in said tubular member and coupled to the walls thereof in a spaced array, and each of said strap means defining a coil receiving loop, and one of a second group of said plurality of coil means different from said first group of said plurality of coil means of said spring-like member in one of said coil member receiving loops of said strap means.

32. The arrangement defined in claim 30, and further comprising:

first flexible flotation member having a specific gravity less than one, in at least some of said cavities of said plurality of pocket means.

33. The arrangement defined in claim 30, and further comprising:

attachment means for coupling said pocket means to said walls of said tubular member and said attachment means comprising:

flexible flap means coupled to said pocket means and to said walls of said tubular member in spaced relationship to said side edges of said pocket means for said pocket means in said transversely upright position thereof, and said flap means substantially taut for said pocket means in said transversely upright position to limit movement of said pocket means.

34. The arrangement defined in claim 30, and further comprising:

flexible upper strap means coupled to said pocket means and extending around said coil means in regions adjacent said upper portions of said tubular member.

35. The arrangement defined in claim 30, wherein:

said pocket means are aligned at substantially said predetermined helix angle for said pocket means in said transversely upright position thereof.

36. The arrangement defined in claim 30, wherein:

said pocket means frictionally engage said coil means for limiting relative circumferential motion thereof.

37. The arrangement defined in claim 31, wherein:

said coil receiving loops frictionally engage said coil means for limiting relative circumferential motion therebetween.

38. The arrangement defined in claim 37, wherein:

said coil receiving loops are aligned in planes substantially perpendicular to the axis of said helix of said spring-like member.

39. The arrangement defined in claim 30, and further comprising:

second flexible flotation member having specific gravity less than one, extending longitudinally in said cavity of said tubular member in regions at said lower portion thereof.

40. The arrangement defined in claim 30, wherein:

said predetermined circumferential distance of said side edges of said pocket means is greater than 180°.

41. The arrangement defined in claim 30, and further comprising:

means for controllingthe deformation of said coil means in said transversely flattened condition thereof.

42. In an improved containment boom section, the improvement comprising, in combination:

flotation means having a predetermined buoyancy to provide upper portions thereof above the surface level of a liquid body for the condition of the boom section deployed in said liquid body, and a lower portion, below the surface level of said liquid body;

said flotation means comprising:

a longitudinally elongated, flexible, generally tubular member having walls defining an internal cavity, upper portions and lower portions and said tubular member transversely collapsible-expandable, between a transversely flattened, storage condition and a transversely expanded, deployed condition, and said elongated, flexible, generally tubular member windable on a reel in said transversely flattened storage condition;

a resilient, generally spring-like member having a plurality of helical coil means about a longitudinally extending helix axis and said helical coils having a predetermined helix angle in a helical condition thereof, and said spring-like member extending longitudinally in said cavity of said tubular member, and said helical coils maintaining said walls of said tubular member in said transversely expanded, deployed condition thereof for said spring-like member in said helical condition thereof, and said spring-like member resiliently deformable from said helical condition to a transversely flattened condition for said tubular member in said transversely flattened storage condition thereof, and said springlike member having a predetermined energy therein in said transversely flattened condition, and said predetermined energy having a value at least equal to the energy required to cause said spring-like member to move from said transversely flattened condition to said helical condition thereof for said flotation means deployed in said liquid body;

and said spring-like member having a first predetermined spacing greater than zero between adjacent coil means thereof for the condition of no axial forces applied thereto;

coupling means for coupling said spring-like member to said walls of said liner means to space adjacent coil means thereof at a second predetermined spacing.

43. The arrangement defined in claim 42, wherein:

said first predetermined spacing is in the range of 0.4 to 1.5 of said second predetermined spacing.

44. The arrangement defined in claim 42, wherein:

said first predetermined spacing is at least equal to said second predetermined spacing.

45. The arrangement defined in claim 42, wherein:

said first predetermined spacing is less than said second predetermined spacing.

46. The arrangement defined in claim 42, and further comprising:

a plurality of pocket means in said cavity of said tubular member, and coupled to the walls thereof in a predetermined, spaced array, each of said pocket means having walls defining a coil receiving cavity having side edges extending a predetermined distance around said walls of said tubular member, from regions adjacent said lower portions thereof toward regions adjacent said upper portions thereof, and said side edges of said pocket means positionable adjacent said walls of said tubular member for said tubular member in said transversely expanded, deployed condition thereof, and one of a first group of said plurality of coil means of said spring-like member in said coil receiving cavity of each of said pocket means, and each of said pocket means movable from a transversely upright position for said tubular member in said transversely expanded, deployed condition thereof to a flattened position for said tubular member in said transversely flattened condition thereof.

47. The arrangement defined in claim 46, wherein:

said first predetermined circumferential distance is less than 360°.

48. The arrangement defined in claim 46, wherein:

said first predetermined circumferential distance is greater than 180°.

49. The arrangement defined in claim 46, wherein said coupling means comprises:

a plurality of strap means in said liner means and coupled to the walls thereof in a spaced array, and each of said strap means defining a coil receiving loop, and one of a second group of said plurality of coil means different from said first group of said plurality of coil means of said spring-like member in each of said coil receiving loops of said strap means.

50. The arrangement defined in claim 46, and further comprising:

attachment means for coupling said pocket means to said walls of said liner means and said attachment means comprising:

flexible flap means coupled to said pocket means and to said walls of said liner means in spaced relationship to said side edges of said pocket means for said pocket means in said transversely upright position thereof, and said flap means substantially taut for said pocket means in said transversely upright position to limit movement of said pocket means.

51. The arrangement defined in claim 50, and further comprising:

upper strap means coupled to said pocket means and extending around said coil means in regions adjacent said upper portions of said tubular member.

52. The arrangement defined in claim 46, wherein:

said pocket means are aligned at substantially said predetermined helix angle for said pocket means in said transversely upright position thereof.

53. The arrangement defined in claim 46, wherein:

said pocket means frictionally engage said coil means for limiting relative circumferential motion thereof.

54. The arrangement defined in claim 49, and further comprising:

said coil receiving loops frictionally engage said coil means for limiting relative circumferential motion therebetween.

55. The arrangement defined in claim 54, wherein:

said coil receiving loops are aligned in planes substantially perpendicular to the axis of said helix of said spring-like member.

56. The arrangement defined in claim 46, and further comprising:

a second flexible flotation member having a specific gravity less than 1, intermediate said liner means and said tubular member in regions adjacent said lower portions thereof.

57. The arrangement defined in claim 46, and further comprising:

said second predetermined distance is substantially equal to said first predetermined distance.

58. The arrangement defined in claim 4, wherein:

said pockets and said flaps define a plurality of spaced apart bulkheads extending at least partially transverse in said tubular member and in liquid tight sealing relationship thereto to limit longitudinal movement of liquid in said bottom portions of said tubular member.

59. The arrangement defined in claim 17, wherein:

said pockets and said flaps define a plurality of spaced apart bulkheads extending at least partially transverse in said liner means and in liquid tight sealing relationship thereto to limit longitudinal movement of liquid in said bottom portions of said liner means.

60. The arrangement defined in claim 33, wherein:

said pockets and said flaps define a plurality of spaced apart bulkheads extending at least partially transverse in said tubular member and in liquid tight sealing relationship thereto to limit longitudinal movement of liquid in said bottom portions of said tubular member.

61. The arrangement defined in claim 50, wherein:

said pockets and said flaps define a plurality of spaced apart bulkheads extending at least partially transverse in said liner means and in liquid tight sealing relationship thereto to limit longitudinal movement of liquid in said bottom portions of said liner means.

62. The arrangement defined in claim 12, wherein:

said means for controlling the deformation of said coil means comprises:

a plurality of strap means, each having an upper end and a lower end, said upper ends at each of said plurality of strap means coupled to one of a second group of said coil means in regions adjacent said upper portions of said tubular member for said spring-like member in said helix condition thereof, and said lower ends of each of said plurality of strap means coupled to said one of said second group of coil means in regions adjacent said lower portions thereof, and said upper ends lead said lower ends in the direction of movement of said coil means into said flattened condition thereof.

63. The arrangement defined in claim 25, wherein:

said means for controlling the deformation of said coil means comprises:

a plurality of strap means, each having an upper end and a lower end, said upper ends at each of said plurality of strap means coupled to one of a second group of said coil means in regions adjacent said upper portions of said tubular member for said spring-like member in said helix condition thereof, and said lower ends of each of said plurality of strap means coupled to said one of said second group of coil means in regions adjacent said lower portions thereof, and said upper ends lead said lower ends in the direction of movement of said coil means into said flattened condition thereof.

64. The arrangement defined in claim 26, and further comprising:

means for controlling the deformation of said springlike member comprising:

a plurality of strap means, each having an upper end and a lower end, said upper ends at each of said plurality of strap means coupled to one of a second group of said coil means in regions adjacent said upper portions of said tubular member for said spring-like member in said helix condition thereof, and said lower ends of each of said plurality of strap means coupled to said one of said second group of coil means in regions adjacent said lower portions thereof, and said upper ends lead said lower ends in the direction of movement of said coil means into said flattened condition thereof.

65. The arrangement defined in claim 41, wherein:

said means for controlling the deformation of said coil means comprises:

a plurality of strap means, each having an upper end and a lowe end, said upper ends at each of said plurality of strap means coupled to one of a second group of said coil means in regions adjacent said upper portions of said tubular member for said spring-like member in said helix condition thereof, and said lower ends of each of said plurality of strap means coupled to said one of said second group of coil means in regions adjacent said lower portions thereof, and said upper ends lead said lower ends in the direction of movement of said coil means into said flattened condition thereof.

66. The arrangement defined in claim 42, and further comprising:

means for controlling the deformation of said spring-like member comprising:

a plurality of strap means, each having an upper end and a lower end, said upper ends at each of said plurality of strap means coupled to one of a second group of said coil means in regions adjacent said upper portions of said tubular member for said spring-like member in said helix condition thereof, and said lower ends of each of said plurality of strap means coupled to said one of said second group of coil means in regions adjacent said lower portions thereof, and said upper ends lead said lower ends in the direction of movement of said coil means into said flattend condition thereof.

* * * * *